United States Patent [19]

Kinoshita et al.

[11] 4,371,446

[45] Feb. 1, 1983

[54] LUBRICANT

[76] Inventors: Hirotsugu Kinoshita, Kawasaki; Hiroshi Uemura, Machida; Makoto Sekiya, Kawasaki, all of Japan

[21] Appl. No.: 205,375

[22] Filed: Nov. 7, 1980

[30] Foreign Application Priority Data

Nov. 15, 1979 [JP] Japan ..... 54/147135
Aug. 29, 1980 [JP] Japan ..... 55/118336

[51] Int. Cl.[3] ..... C10M 1/26; C10M 1/36
[52] U.S. Cl. ..... 252/51.5 A; 252/34.7
[58] Field of Search ..... 252/51.5 A, 34.7

[56] References Cited

U.S. PATENT DOCUMENTS 2,736,658 2/1956 Pfohl et al. ..... 252/51.5 A
2,798,045 7/1957 Buck et al. ..... 252/32.7
2,842,837 7/1958 Huet et al. ..... 252/51.5 A
2,971,914 2/1961 Shoemaker ..... 252/51.5 A

*Primary Examiner*—Jacqueline V. Howard
*Attorney, Agent, or Firm*—McGlew and Tuttle

[57] ABSTRACT

There is disclosed a lubricant the major portion of which is composed of Duomeen-T-dioleate. It may be associated with a diamide compound of the formula $$R^2\underset{\underset{O}{\|}}{C}NHR^1HN\underset{\underset{O}{\|}}{C}R^2$$

wherein $R^1$ is a $C_{2-4}$ alkylene radical and $R^2$ is a $C_{14-18}$ alkyl or alkenyl radical, or with various kinds of thickeners and/or waxes. The resulting lubricant has superior performance when applied to a metal-metal, metal-plastics or plastics-plastics sliding surface.

19 Claims, 2 Drawing Figures

LUBRICANT

BACKGROUND OF THE INVENTION (1) Field of the Invention

This invention relates to a lubricant for use in a sliding surface between metals or non-metallic materials, or between a metal and a non-metallic material. More specifically, this invention relates to a lubricant suitable for application to a ball joint composed of a metallic ball stud and a plastic ball seat.

(2) Description of the Prior Art

In recent years, various lubricants have been developed for use in sliding surfaces between metals or plastics or between a metal and plastics. In order to reduce the weight and cost of machines parts, plastic materials such as polyacetal resins, polyethylene, polypropylene, polyamide resins, polycarbonate, ABS resin and polyimide resins have come into widespread use in gears, bearings particularly rolling bearings, cables for automobile speedometers, ball joints, etc. These plastic materials have superior self-lubricating properties, and are used as sliding members in a dry condition. In order to make it possible to use them under severe conditions, their lubricating properties such as friction and wear need to be improved. For this purpose, lubricating oils such as mineral oil-type lubricating oils, synthetic hydrocarbon oils, and ester-type synthetic lubricating oils, and various lubricating greases containing the aforesaid oils as base oils have been used heretofore.

This is the same with regard to a sliding portion between metals and between a metal and a plastic material, and it has been desired to develop a novel lubricant having a much lower coefficient of friction than conventional lubricanting oils in order to prevent or reduce friction, wear, noises, heat generation at frictional parts, etc.

Generally, ball joints used in automobile suspension devices, steering device, etc. are rigorously required to have a predetermined constant low operating torque, a minimum amount of ball stud displacement (or play) under load, and excellent durability. In order to meet this requirement, improvements have been achieved heretofore by, for example, increasing the working precision of component parts, selecting a flexible synthetic resin for ball seats, or by providing a spring in the ball seats. These improvements, however, give rise to problems. For example, even when a high precision is obtained, the cost of production rises. Or although a soft flexible synthetic resin permits easy fitting with a spherical head portion, it is liable to undergo a cold flow under load. Thus, the range of applicability is narrow, and the durability of such a ball joint is not entirely satisfactory. When a spring is provided in a ball seat, both the weight and the cost of the ball joint increase. As regades its performance, the amount of play increases when the operating torque is set at a low value. It has been much expected therefore that the aforesaid various problems would be solved by filling a specified lubricant between a ball stud and a ball seat. However, no good result has been obtained with conventional greases, such as Li soap grease, having excellent frictional characteristics.

SUMMARY OF THE INVENTION

It is an object of this invention to provide a lubricant which is conductive to improvement of the lubricating properties, such as friction and wear, of the various kinds of sliding surfaces mentioned hereinabove.

Another object of this invention is to provide an excellent lubricant for ball joints which meets the aforesaid expectation. Application of this lubricant has made it possible to obtain a well-balanced torque value which the aforesaid various mechanical improvements alone have been unable to give.

BRIEF DESCRIPTION OF THE DRAWINGS

In FIG. 1, the X and $\sigma$ of the torque curves are as follows:

| | Static Oscillating torque | Static rotating torque | Dynamic oscillating torque | Dynamic rotating torque |
|---|---|---|---|---|
| Grease B of the Invention | X = 0.129<br>$\sigma$ = 0.008 | X = 0.100<br>$\sigma$ = 0.010 | X = 0.085<br>$\sigma$ = 0.008 | X = 0.111<br>$\sigma$ = 0.008 |
| Commercial Grease | X = 0.325<br>$\sigma$ = 0.013 | X = 0.199<br>$\sigma$ = 0.027 | X = 0.103<br>$\sigma$ = 0.008 | X = 0.145<br>$\sigma$ = 0.018 |

Figure 1:
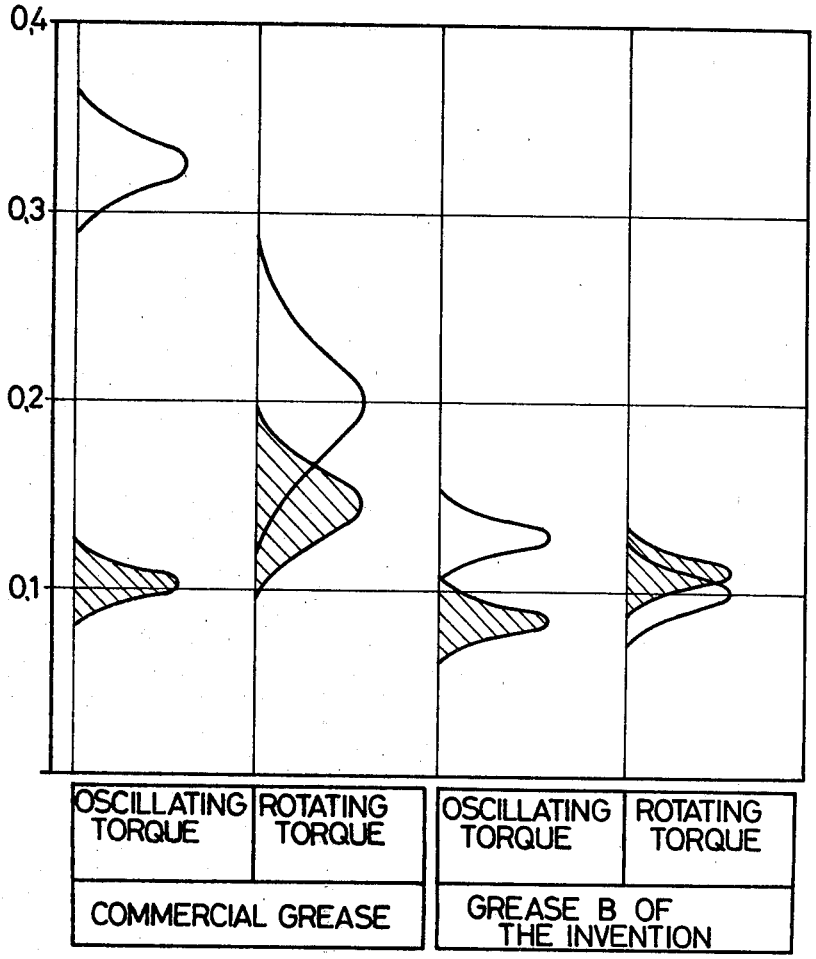
FIG. 1 shows curves of static torques and dynamic torques of ball joints having sealed therein a lubricant B in accordance with this invention and a commercially available Li soap.

In FIG. 1, the curves in the hatched areas show the dynamic torques; and the curves in the non-hatched areas, the static torques. The ball joint used in the test shown in FIG. 1 consists of the following component parts.

Socket: made of steel

Ball seat: made of oil-containing polyethylene (OILES#81, a tradename)

Ball stud: with a spherical head portion having a diameter of 20 mm

The amount of pre-load:

Circumferential direction of the ball seat: 0.2–0.5 mm

Axial direction of the ball seat: 0.2–0.6 mm

Figure 2:
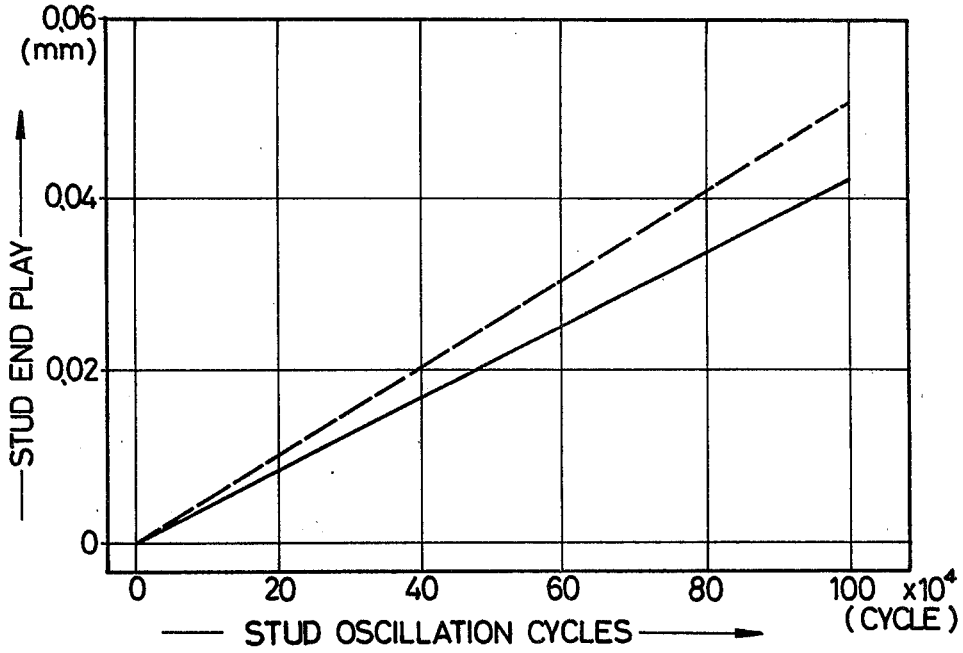

FIG. 2 is a graph showing the durability of a ball joint when a lubricant C in accordance with this invention and a commercially available Li soap grease are used.

In FIG. 2, the relation between the durability and the amount of increase of stud end play obtained when using the lubricants B and C of this invention is on the same straight line shown by the solid line, and the relation obtained when using the commercially available Li soap grease is the straight line shown by the broken line.

The test conditions shown in FIG. 2 are as follows:

| | |
|---|---|
| Load (the radial direction of the stud): | ±350kg 30 cpm |
| Stud oscillation ±25° 60 cpm | |
| Stud rotation | ±20° 60 cpm |

The component parts of the ball joint tested are as follows:

Socket: made of steel

Ball seat: made of oil-containing polyethylene

Ball stud: with a spherical head portion having a diameter of 20 mm.

DETAILED DESCRIPTION OF PREFERRED EMBODIMENTS

The characteristic feature of the present invention is that Duomeen T dioleate is used as a base oil, and, if desired, a diamide compound of the following formula (I) is mixed therewith.

$$R^2\underset{\underset{O}{\|}}{C}NHR^1HN\underset{\underset{O}{\|}}{C}R^2 \qquad (I)$$

wherein $R^1$ represents an alkylene radical having 2 to 4 carbon atoms, and $R^2$ represents an alkyl or alkenyl radical having 14 to 18 carbon atoms.

Duomeen T diolate (Duomeen T D O) can be easily obtained by reacting Duomeen T with oleic acid, as schematically shown below.

$$\underset{\text{Duomeen T}}{R^3\overset{H}{\overset{|}{N}}CH_2CH_2NH_2} + \underset{\text{oleic acid}}{2R^4COOH} \longrightarrow \underset{\text{Duomeen T dioleate}}{R^3-\overset{R^4COO^{\ominus}}{\overset{|}{N}}{}^{\oplus}H_2CH_2CH_2\overset{^{\ominus}OOCR^4}{\overset{|}{\oplus}}NH_3}$$

In the above formula, $R^3$ represents a hydrocarbon residue of a tallow fatty acid and $R^4$ oleyl radical.

For convenience herein, and especially in the appended claims, such Duomeen T Dioleate may be considered as having the formula $(R^3NH_2CH_2CH_2NH_3)++2(OOCR^4)$ in which $R^3$ and $R^4$ are the same as defined above.

Duomeen T dioleate is known as a rust inhibitor for lubricating oils. In fields where Duomeen T dioleate has been used previously, it is an additive to lubricating oils, and it has never been used as a base oil for lubricating oils. The amount of the Duomeen T dioleate in conventional usage is about 5% at most.

Investigations of the present inventors have shown that use of Duomeen T dioleate as a lubricant leads to excellent lubricating properties for the various sliding surfaces mentioned hereinabove.

In the present invention, the diamide compound of the above formula (I) is added to Duomeen T dioleate. It has been found that very good lubricating properties can be obtained when 5 to 30% by weight, preferably 12 to 25% by weight, of the diamide compound of the formula (I) is added to Duomeen T dioleate. When the diamide compound of the formula (I) is added to Duomeen T dioleate as a base oil, the resulting lubricant becomes gradually solid as the amount of the diamide compound (I) increases. When the lubricating property of the resulting lubricant is considered, it desirably has a melting point of at least 60° C.

In addition to the two essential ingredients, various additives such as antioxidants and metal deactivators may be incorporated as desired in the lubricant of this invention. The suitable amount of an antioxidant to be added is 0.1 to 3% by weight, and the suitable amount of a metal deactivator is 0.01 to 0.1% by weight, both based on the weight of the lubricant composition.

The lubricant of this invention can be used for various types of ball joints, but is especially suitable for use in ball joints composed of a metallic ball stud and a plastic ball seat. As a result of using the lubricant of this invention, the plastic forming the ball seat needs not always to be a soft flexible resin, but can be selected from various kinds of synthetic resins including fluorine-containing resins, polyester resins, polyolefin resins such as polyethylene, and polyacetal resins.

If required, various types of thickeners or waxes may be incorporated in Duomeen T dioleate as a base oil in the lubricant of this invention. The thickeners used for this purpose are those generally used in mineral oil-type lubricating greases or synthetic oil-type lubricating greases. Examples include soaps of alkali metals such as Li and Na or alkaline earth metals such as Ca and Mg, organic compounds having a ureido linkage such as diurea and tetraurea, organic compounds having an amide linkage, and inorganic compounds typified by modified bentonite and silica gel. The waxes used for this purpose are a variety of waxes of the mineral oil type or synthetic waxes. Specific examples include montan wax, carnauba wax, amide compounds of higher fatty acids, paraffin waxes, microcrystalline waxes, polyolefin waxes, and ester waxes.

If desired, antioxidants, rust inhibitors, corrosion inhibitors, antiwear agents, and solid lubricants (e.g., PTFE and $MoS_2$), which are used in conventional greases, etc., may be added to the resulting lubricant composition of this invention.

The following Examples further illustrate the present invention.

EXAMPLE 1

Duomeen T dioleate and as a comparison, a lubricating oil fraction of SAE 30 (viscosity index 95) were used as samples. There was used the Bowden-Leben friction tester in which on a plate made of one material, a spherical member (3 mm in diameter) made of another material makes a reciprocating motion while sliding on a straight line. Under a load of 0.5 kg and at a sliding speed of 3.6 mm/sec., the friction coefficient in the presence of the above samples was measured. The results are shown in Table 1.

TABLE 1

| Results of measurement of the friction coefficient | | | |
|---|---|---|---|
| Material of the sperical member | Material of the plate | Samples: Lubricating oil fraction from Arabian light crude oil | Samples: Duomeen T dioleate |
| Steel | Lead | 0.136 | 0.064 |
| | Copper | 0.124 | 0.080 |
| | Silver | 0.090 | 0.045 |
| | Delrin | 0.041 | 0.018 |
| | Polypropylene | 0.042 | 0.027 |
| | 66 Nylon | 0.063 | 0.028 |
| | Steel | 0.093 | 0.043 |
| Silver | Copper | 0.150 | 0.070 |
| | Silver | 0.166 | 0.090 |
| | Phosphor bronze | 0.175 | 0.075 |
| | Phosphor bronze | 0.140 | 0.100 |
| Brass | Delrin | 0.110 | 0.070 |
| | 66 Nylon | 0.120 | 0.090 |
| | Steel | 0.049 | 0.020 |
| | Copper | 0.112 | 0.043 |
| Delrin | Silver | 0.090 | 0.040 |
| | Phosphor bronze | 0.115 | 0.037 |
| | Delrin | 0.065 | 0.029 |
| | 66 Nylon | 0.058 | 0.035 |

It is seen from Table 1 that Duomeen T dioleate used as a lubricant showed much lower friction coefficients on various types of sliding surfaces than did a conventional lubricating oil, and therefore, had excellent lubricating properties on various types of sliding surfaces.

EXAMPLE 2

The operating torque characteristics of the lubricant of the present invention were evaluated by using a ball joint composed of a steel ball stud, a bearing made of oil-containing polyethylene and a steel socket.

| | |
|---|---|
| Ball joint Specification | |
| Ball stud: | made of steel with a spherical head portion having a diameter of 20 mm |
| Ball seat: | made of oil-containing polyethylene (OILES #81, a tradename of a product made by OILES Industry Co., Ltd. Japan) |
| Socket: | made of steel |
| Lubricant A | |
| Duomeen T dioleate | 85% by weight |
| Ethylene bis-oleylamide | 15% by weight |
| Lubricant B | |
| Lubricant A | balance |
| Phenolic antioxidant | 1.0% by weight |
| Metal deactivator | 0.1% by weight |
| Lubricant C | |
| Duomeen T dioleate | balance |
| Ethylenebis-oleyldiamide | 20% by weight |
| Phenolic antioxidant | 1.0% by weight |
| Metal deactivator | 0.1% by weight |

In measuring the torque, the socket was fixed, and a jig having a certain fixed length from the center of the stud sphere was secured to the stud. The force at this jig in oscillation or rotation was measured and defined as the oscillating torque or rotating torque. The torque generated when the ball joint was first oscillated or rotated while the measuring device was in the stationary state was defined as the static torque, and the torque generated after pivotally rotating the stud 5 to 10 times was defined as the dynamic torque.

The various lubricants shown in Table 2 were sealed respectively into ball joints, and the operating torques were measured. The operating torque characteristics of both A and B were approximately equal to each other and the test result of B is shown in FIG. 1 of the accompanying drawings.

TABLE 2

| | |
|---|---|
| Lubricants A and B of the invention | |
| Comparison: | Li soap grease made by Nippon Oil Co., Ltd. (LIPANOC DX 2, a tradename) |

It is seen from FIG. 1 that both the oscillating torque and the rotating torque showed a great decrease in static torque values, and their variations were markedly reduced, and that the difference between the static torque values and the dynamic torque values was very small.

This shows that the lubricants of this invention are much better than conventional greases such as Li soap grease.

When the lubricant of this invention was used, not only could the torque value be maintained at a low value, but also in respect of the dynamic torque, the rotating torque could be made higher than the oscillating torque. Accordingly, when the lubricant of this invention is used in an automobile suspension mechanism, the shimmy phenomenon believed to be due to the deflection of tires during driving can be inhibited.

EXAMPLE 3

Lubricant C of the present invention and a commercial lubricant were each sealed into ball joints consisting of a steel ball stud (with a spherical head portion having a diameter of 20 mm) and a ball seat made of polyacetal (OILES #80, a tradename for a product of OILES, Industry Co., Ltd. Japan). The ball joints were then subjected to a durability test under the following conditions.

| Testing conditions | | |
|---|---|---|
| 1. | Load Ball stud | |
| | Axial direction | ±350 kg, 30 cpm |
| | Radial direction | ±900 kg, 60 cpm |
| 2. | Ball stud | |
| | Oscillation | ±25°, 60 cpm |
| | Rotation | ±20°, 60 cpm |

The test results are shown in FIG. 2 in which abscissa represents the durability and ordinate, varying amounts of stud end play.

The amount of the stud end play denotes the amount of movement of the ball stud relative to the housing which is measured when the housing is fixed and a predetermined load is exerted statically on the ball stud in a predetermined direction. In the present test, it denotes the amount of the end play which was measured when a pull out load of 350 kg was applied to the ball stud in the axial direction of the housing.

It is seen from FIG. 2 that when the lubricant of this invention is sealed into the ball joint, it showed a marked increase in durability over the ball joint into which the conventional Li soap grease has been sealed. In other words, this means that when it is desired to obtain a certain operating torque, the internal stress of a plastic ball seat can be increased by increasing the clamping space for the ball seat, and consequently, the durability of the ball joint increases.

Since the lubricant of this invention lubricates a sliding surface between the spherical head portion of a ball stud and the concave surface of a plastic ball seat, it can be applied to all types of ball joints which includes plastic ball seats.

What is claimed is:

1. Method of lubricating sliding surfaces composed of metal or non-metallic materials in sliding contact with each other which comprises applying to such sliding surfaces an effective lubricating amount of a lubricant comprising as a major component a dioleate compound of the formula $$(R^3NH_2CH_2CH_2NH_3)^{++}2(OOCR^4)^-$$

in which $R^3$ is the corresponding hydrocarbon radical of a tallow fatty acid and $R^4$ is an oleyl radical and about 5 to 30% by weight of a diamide compound of the formula $R^2CO—NHR^1HN—CO—R^2$ in which $R^1$ is an alkylene radical having 2 to 4 carbon atoms, and $R^2$ is selected from the group consisting of an alkyl radical and an alkenyl radical, each correspondingly having 14 to 18 carbon atoms.

2. Method according to claim 1, wherein the lubricant has a melting point of at least about 60° C.

3. Method according to claim 1 wherein the sliding surfaces are spherical surfaces.

4. Method according to claim 3 wherein the sliding surfaces comprise a ball stud and a ball seat of a ball socket.

5. Method according to claim 4, wherein the ball stud has a metal sliding surface and the ball seat has a plastic sliding surface.

6. Method according to claim 1 wherein the lubricant additionally contains at least one antioxidant.

7. Method according to claim 1 wherein the lubricant additionally contains at least one inhibitor selected from the group consisting of rust inhibitors and corrosion inhibitors.

8. Method according to claim 1 wherein the lubricant additionally contains at least one antiwear agent.

9. Method according to claim 1 wherein the lubricant additionally contains at least one separate solid lubricant as an additional lubricant therein.

10. Method according to claim 1 wherein the lubricant contains at least one thickener selected from the group consisting of soaps of alkali metals, soaps of alkaline earth metals, diurea, tetraurea, modified bentonite, and silica gel.

11. Method according to claim 1 wherein the lubricant additionally contains at least one wax selected from the group consisting of montan wax, carnauba wax, amide compounds of higher fatty acids, paraffin waxes, microcrystalline waxes, polyolefin waxes, and ester waxes.

12. Lubricant comprising as the base component a dioleate compound of the formula $$(R^3NH_2CH_2CH_2NH_3)^{++}2(OOCR^4)^-$$

in which $R_3$ is the corresponding hydrocarbon radical of a tallow fatty acid and $R^4$ is an oleyl radical, and about 5 to 30% by weight of the lubricant of a diamide compound of the formula $$R^2CO—NHR^1HN—CO—R^2$$

in which $R^1$ is an alkylene radical having 2 to 4 carbon atoms, and $R^2$ is selected from the group consisting of an alkyl radical and an alkenyl radical, each correspondingly having 14 to 18 carbon atoms.

13. Lubricant according to claim 12 wherein the lubricant has a melting point of at least about 60° C.

14. Lubricant according to claim 12 wherein the lubricant additionally contains at least one antioxidant.

15. Lubricant according to claim 12 wherein the lubricant additionally contains at least one inhibitor selected from the group consisting of rust inhibitors and corrosion inhibitors.

16. Lubricant according to claim 12 wherein the lubricant additionally contains at least one antiwear agent.

17. Lubricant according to claim 12 wherein the lubricant additionally contains at least one separate solid lubricant as an additional lubricant therein.

18. Lubricant according to claim 12 wherein the lubricant additionally contains at least one thickener selected from the group consisting of soaps of alkali metals, soaps of alkaline earth metals, diurea, tetraurea, modified bentonite, and silica gel.

19. Lubricant according to claim 12 wherein the lubricant additionally contains at least one wax selected from the group consisting of montan wax, carnauba wax, amide compounds of higher fatty acids, paraffin waxes, microcrystalline waxes, polyolefin waxes, and ester waxes.

* * * * *

UNITED STATES PATENT AND TRADEMARK OFFICE

CERTIFICATE OF CORRECTION

PATENT NO. : 4,371,446

DATED : February 1, 1983

INVENTOR(S) : Hirotsugu Kinoshita et al.

It is certified that error appears in the above-identified patent and that said Letters Patent is hereby corrected as shown below:

On the title page insert:

-- [73] Assignee: Nippon Oil Company, Ltd., and Musashi Seimitsu Kogyo Kabushiki Kaisha --.

Signed and Sealed this

*Fifth* Day of *July 1983*

[SEAL]

*Attest:*

GERALD J. MOSSINGHOFF

*Attesting Officer*

*Commissioner of Patents and Trademarks*